United States Patent [19]

Bustos

[11] Patent Number: 4,809,855

[45] Date of Patent: Mar. 7, 1989

[54] DISPLAY RACK

[75] Inventor: Rafael T. Bustos, Alpharetta, Ga.

[73] Assignee: Legettt & Platt, Incorporated, Cathage, Mo.

[21] Appl. No.: 66,986

[22] Filed: Jun. 24, 1987

[51] Int. Cl.[4] ..... A47F 7/00

[52] U.S. Cl. ..... 211/59.2; 211/150

[58] Field of Search ..... 211/59.2, 59.1, 59.3, 211/153, 193, 126, 133, 151, 187, 182, 150; 108/108, 109

[56] References Cited

U.S. PATENT DOCUMENTS

| | | | |
|---|---|---|---|
| 3,045,831 | 7/1962 | Pendergrast, Jr. et al. . | |
| 3,137,251 | 6/1964 | Pendergrast, Jr. . | |
| 3,616,938 | 11/1971 | McAleenan et al. . | |
| 3,677,203 | 7/1972 | Barrineau . | |
| 4,128,177 | 12/1978 | Bustos | 211/59.2 |
| 4,204,480 | 5/1980 | Hanna . | |
| 4,314,648 | 2/1982 | Spamer . | |
| 4,415,090 | 11/1983 | Bustos | 211/150 X |
| 4,461,388 | 7/1984 | Bustos . | |
| 4,705,175 | 11/1987 | Howard et al. | 211/59.2 |

OTHER PUBLICATIONS

Catalog page for Mead "Mead Standard Height Gladiator with Gravity Base," pp. 241, 242.

Catalog page for Mead "Canopy Height Gladiator with Deepwell Base," pp. 237, 238.

Catalog page for Mead "Standard Height Gladiator with Deepwell Base," p. 239.

Catalog page for Mead "Canopy Height Gladiator with Gravity Base," p. 243.

Catalog page for Mead "Minishop Gladiator Convenience Store Gondola," p. 247.

*Primary Examiner*—Reinaldo P. Machado

*Assistant Examiner*—Sarah A. Lechok Eley

*Attorney, Agent, or Firm*—Wood, Herron & Evans

[57] ABSTRACT

A high density pack out gondola display rack comprises a fixed base, an upright extending vertically from the rear of the fixed base, which upright has at least two parallel columns of vertically spaced slots from which at least one shelf is supported in cantilever fashion over the fixed base. Both the base and the shelf have downwardly and forwardly sloping top surfaces such that product supported on the top surfaces slide forwardly against abutments at the front edge of the base and shelf. In the preferred embodiment, a fixed display rack having multiple columns and rows of forwardly and downwardly sloping shelves is mounted on the base. There are also in the preferred embodiment of the invention spring-up shelves supported from the upright and extending over the base, which spring-up shelves also slope downwardly and forwardly when product is supported thereon so that the product supported upon the spring-up shelves slides downwardly and forwardly over the spring-up shelves into engagement with an abutment at the front edge of the spring-up shelves.

39 Claims, 6 Drawing Sheets

DISPLAY RACK

This invention relates to display racks, and more particularly to an improved gondola display rack of the gravity-feed type.

The invention of this application is particularly adapted, but not necessarily limited, to use in the merchandising of beverages, as for example, soft drinks and beer. Gondola display racks, constructed primarily of sheet metal, are commonly used in grocery stores, supermarkets, and the like for the display and merchandising of beverages. Beverages are sold in bottles and containers of various sizes, the smaller bottles being commonly packaged in cartons, and the larger multi-liter sizes being generally in the form of individual bottles. The sizes of the small bottles may vary, and the relative proportion of cartons to large bottles in a particular display also varies, depending upon the demand experienced by a particular vendor. For these reasons, gondola display racks are commonly supplied with vertically movable shelves adapted to be positioned for optimum usage of available space.

A typical gondola display rack comprises a sheet metal base and a vertical upright extending upwardly from the rear of the base. Beverage cartons are normally stacked on the base, and larger bottles are normally arranged on shelves supported from the upright and cantilevered over the base. In order to stabilize the stack of cartons, the upper surface of the base is commonly tilted backwardly by a few degrees. This backward tilting has heretofore been provided in order to stabilize a stack of cartons resting upon the rearwardly tilted base, which stack can be four or five cartons high.

A common problem characteristic of gondola displays is that the capacity of such displays is limited, primarily because of the need to maintain stability in the rack when it is fully loaded with product. The merchandiser would like to increase the capacity of gondola displays, particularly if that could be accomplished without increasing the floor space occupied by the gondola. The design of the gondola and the maximum height to which customers can effectively reach has, though, heretofore limited the capacity of such displays.

Another problem characteristic of gondola displays is that there is very little flexibility in the mix of products which may be displayed on the lower portion of the gondola display. This lack of flexibility is primarily attributable to the fact that all of the product displayed in a single row of products and then in a single stack of products on the lower portion of the gondola display must be identical. Any mix of products in a single row and stack would make it impossible to remove a second or third product in a single row or in a single stack without removing products in front of or on top of the desired packaged product.

It has therefore been an objective of this invention to provide an improved gondola display wherein the capacity of the display may be markedly increased without any appreciable increase in floor space occupied by the gondola display.

In accordance with the practice of this invention, the improved gondola display of this invention effects anywhere from a 40 to 60 percent increase in the capacity or "pack-out" of a gondola display over that possible with prior art gondola displays of the type described hereinabove.

Still another objective of this invention has been to provide a gondola display which is amenable to greater flexibility of product mix than prior art gondola displays of the type described hereinabove. In accordance with one aspect of this invention, identical products must be packaged in each row of product, but each stack of rows may be occupied by different products, all of which are equally accessible without any need for removable of one product in order to access another.

A gondola display rack made in accordance with the invention of this application comprises a sheet metal base and a vertical upright support extending upwardly from the rear of the base. The base, according to the practice of this invention, though, has a forwardly and downwardly sloping top surface such that all products supported upon the base are gravity fed forwardly over the base to a front stop located along the front edge of the base. Mounted above the fixed base are multiple shelves adjustably mounted upon the upright support and cantilevered over the base. Each of the shelves has a forwardly and downwardly sloping top surface operative to gravity feed products supported upon the shelf to the front edge of the shelf. Because of this parallel orientation of the top surface of the base and the top surface of the shelves, a greater capacity of product may be stored upon the gondola display than has heretofore been possible when the shelves were either horizontal or downwardly and rearwardly sloping. The gondola display made in accordance with the invention of this application also has a plurality of spring-up shelves mounted above the base and below the cantilevered shelves. Each of the spring-up shelves is mounted such that it will support a plurality of packaged products in such a fashion as to gravity feed the products stored on the top of the spring-up shelf to the front edge of the shelf. So long as product rests atop the spring-up shelf, the shelf in turn rests upon products supported beneath it. As soon as the last package of product is removed from the spring-up shelf, the shelf springs upwardly so as to facilitate access to product mounted beneath the raised spring-up shelf.

As an alternative or in addition to locating a plurality of spring-up shelves between the base and cantilevered shelves mounted atop the base, a fixed shelf supporting frame may be attached to the base. This frame supports an array of horizontally aligned and vertically stacked shelves, each of which slopes downwardly and forwardly parallel to the top surface of the base. Each shelf in turn is individually slidable on the frame such that it may be lifted and pulled forwardly until only the rear edge of the shelf is supported upon the frame. In this pulled out position of the shelf, it may be quickly loaded with product and then returned to its originally forwardly and downwardly sloping position in the frame wherein the shelf loaded with product slopes forwardly and downwardly in parallel with the top surface of the gondola base.

The improved gondola display of this invention has many advantages over prior art gondola displays. Among those advantages is that all product supported upon the display is gravity fed to the forward edge of the base or each shelf of the display, whether that product is a package of bottles or containers or a plurality of individual bottles or containers. Because of this characteristic of the display, the capacity of the display is greatly increased over prior art displays, as well as the ease of access of product located in the display. Additionally, the use of a fixed frame with a plurality of slide-out shelves on the bottom portion of the display facilitates greater flexibility of product mix within the display. Each shelf may contain a different product, even though the shelves are stacked immediately above one another. Sufficient clearance is left between the vertically stacked shelves so as to enable different products to be mounted on each shelf and still remain fully accessible to customers at the front of the shelf. Because the shelves slide out on the fixed frame, the shelves may be more quickly loaded with packages of products that has heretofore been possible when fixed shelves were mounted upon the frame.

The invention of this application also envisions utilizing snap-in organizers on each cantilevered shelf of the display or upon the top surface of the base. These organizers also enable different sizes of cartons and different sizes of bottles to be supported upon the top surface of the base or the cantilevered shelves. All that is required to vary the mix of package and bottle size is to reposition the organizer and then the slip surfaces usually located between the organizers.

The invention of this application also includes an improved mounting assembly for the spring-up shelves. This improved mounting assembly is intended to be supported from slots on the front surface of the shelf supporting upright. In order to enable the spring-up shelves to be mounted in varying vertical orientations, as well as horizontal orientations, the spring-up shelves are mounted for lateral, as well as horizontal, adjustment on a bracket support assembly. Because of the adjustability of this spring-up support assembly, the shelves may be positioned at an infinite number of positions on the upright, and thereby the height and width of packages accommodated by the gondola display utilizing the spring-up shelves may be maximized.

These and other objects and advantages of this invention will be more readily apparent from the following description of the invention in which.

Figure 1:
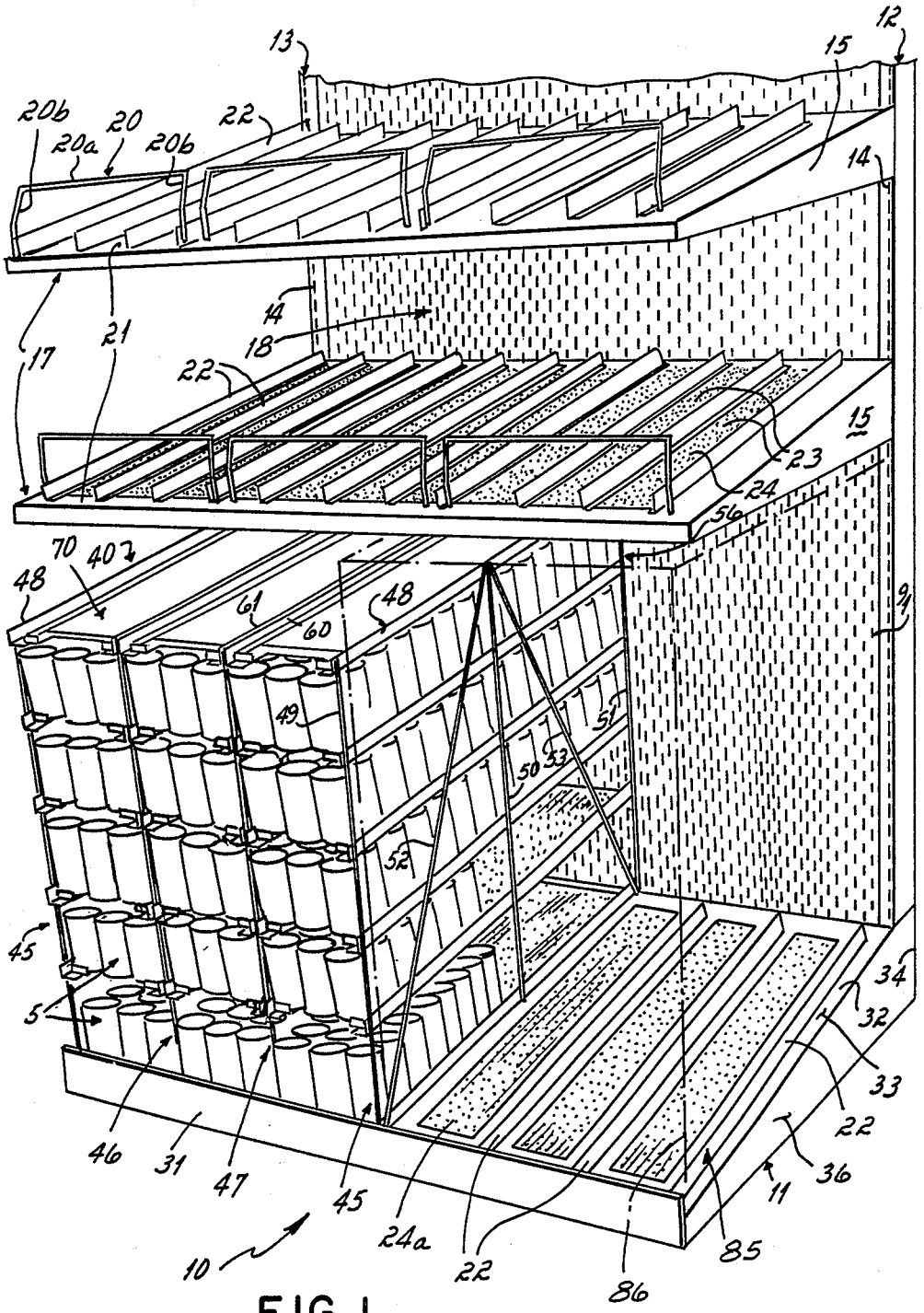
FIG. 1 is a perspective view of a gondola display incorporating the invention of this application, but with the spring-up shelves of the display removed for clarity of the drawing.
Figure 2:
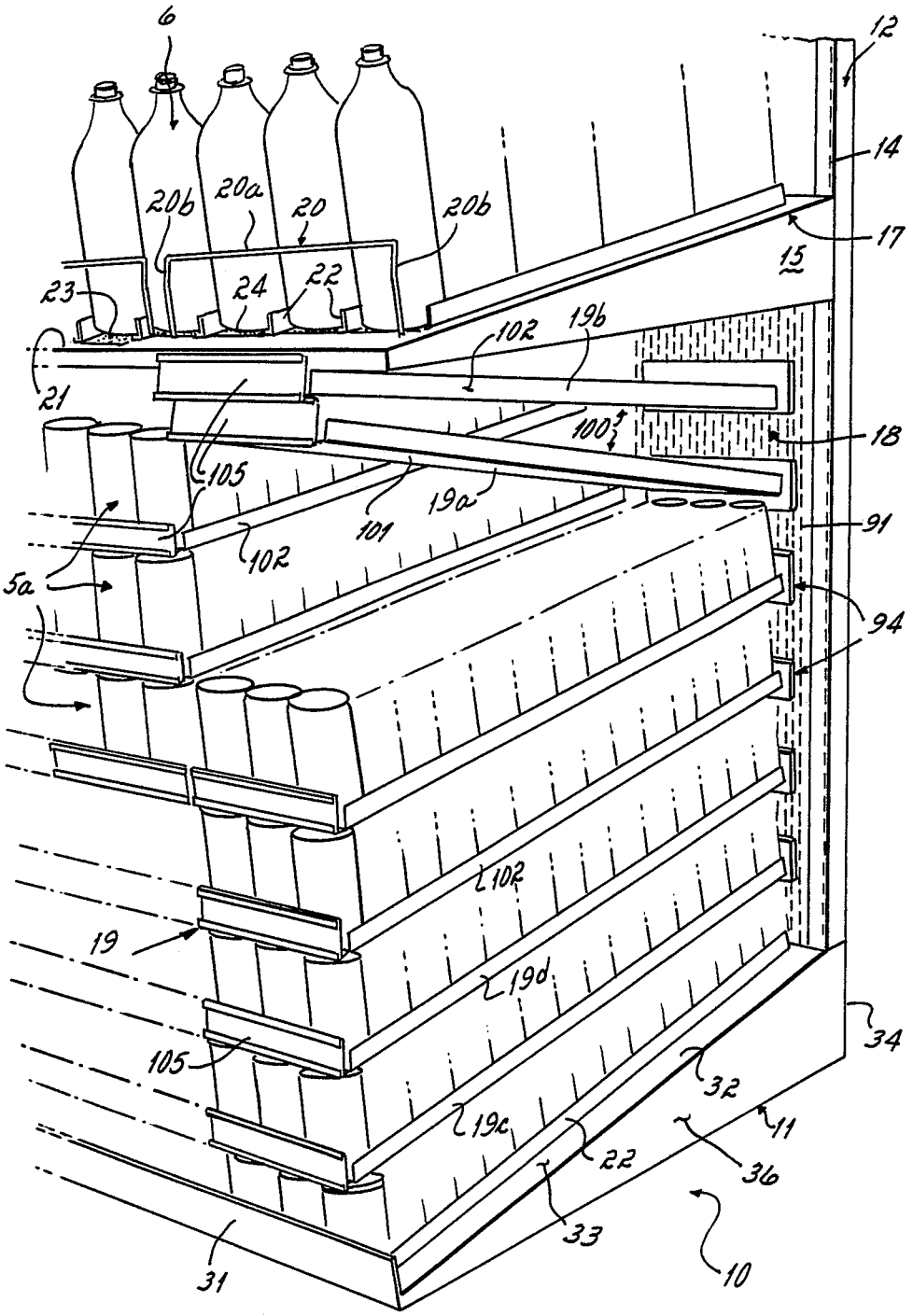
FIG. 2 is a perspective view of the spring-up shelf support portion of the display of FIG. 1, but with the spring-up shelves in place on the display.

Referring first to FIG. 1, there is illustrated a beverage gondola display or so-called gondola rack 10 for displaying packages of beverage products 5 or individual bottled products 6 (FIG. 2). Such displays or racks are commonly used for displaying beverage bottles or packages of beverages in stores or retail establishments.

The gondola display rack 10 comprises a wedge-shaped base 11 to which are attached vertical side posts 12 and 13. The front edges of these posts 12 and 13 define spaced, vertical slots 14 adapted to receive hook-shaped tabs (not shown) of shelf mounting brackets 15 for removable securement of shelves 17 upon the posts 12 and 13. A back panel 18 spans the area between the side posts 12 and 13 and serves, as explained more fully hereinafter, as a support for spring-up shelves 19 (FIG. 2) and for a fixed shelf frame 40.

In FIG. 1, the gondola rack 10 is illustrated as having two shelves 17, the top surfaces of which slope downwardly and forwardly at an angle of approximately 8° so as to facilitate sliding of bottles or articles supported upon the top surfaces of the shelves forwardly to the front edge of the shelf and against an abutment 20 secured to the front edge of the shelf. In the illustrated embodiment, the abutment 20 comprises multiple U-shaped wires **20*a* having a horizontal span and two vertical legs extending downwardly from opposite ends of the horizontal span. The lower ends of these legs 20*b*** are mounted within mounting holes at the front edge of the shelves.

In accordance with the practice of this invention and as best illustrated in FIGS. 1 and 2, there are multiple channel-shaped or L-shaped dividers 22 mounted upon the top surface 21 of each shelf 17. The bottom surface of these sheet metal dividers 22 has downwardly extending, hook-shaped, tabs pressed therefrom such that the dividers may be attached to the top surface of the shelf at any desired location by simply inserting the tabs into holes formed in the top surface 21 of each shelf. Preferably, such divider is secured or locked to the top surface of the shelf by a conventional sheet metal screw extending downwardly through the channel and the top surface of the shelf. Thereby, a trackway 23 is defined between two adjacent dividers 22 for the support of a column of packages or bottles 6. In FIG. 2, the bottles 6 are illustrated as two-liter bottles. They could as well, though, be individual beverage cans or packages of beverage cans or bottles, in which event the spacing between adjacent dividers 22 would be different from that illustrated in FIGS. 1 and 2. Each trackway 23 defined between adjacent dividers 22 is provided with a strip 24 of silicone impregnated plastic material over which the bottles 6 slide. The strip of silicone impregnated plastic material provides a slip surface which enables the beverage bottles 6 to slide downwardly and forwardly over the downwardly and forwardly sloping surface 21 whenever the forwardmost bottle in a column of bottles is removed from the shelf. One material suitable for use as a strip 24 for supporting a column of bottles 6 is completely described in U.S. Pat. No. 4,314,648. Another material suitable for use as a slip surface is described in U.S. Pat. No 4,461,388. Obviously, other materials are suitable for forming strips 24 of slippery material over which plastic bottles or beverage containers could slide with a minimum of friction between the bottle and the slip surface.

Figure 4:
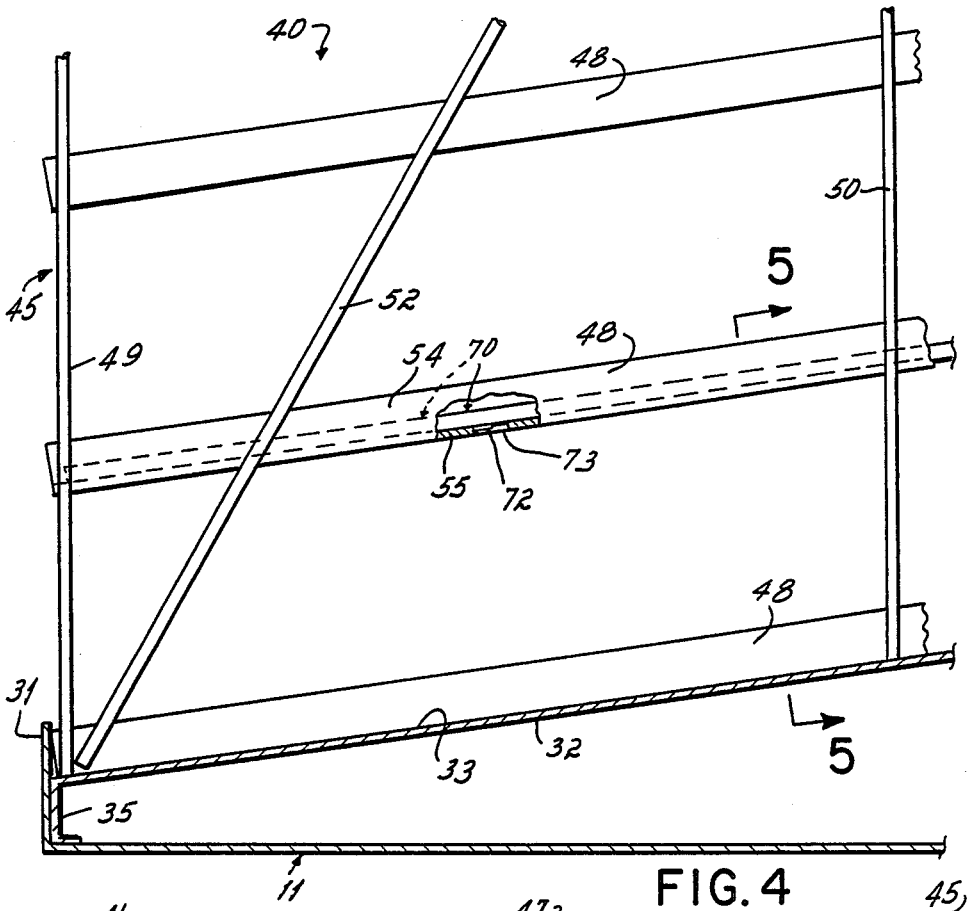
FIG. 4 is a cross-sectional view taken on line 4—4 of FIG. 3.

With reference now to FIGS. 2 and 4, it will be seen that the wedge-shaped based 11 comprises a sheet metal bottom plate, the forward edge of which is bent upwardly into a vertical plane to form a front lip 31 on the base. A top plate 32 extends upwardly and rearwardly from a midpoint on the front lip or front wall 31 of the base. The top surface 33 of this top plate 32 forms a downwardly and forwardly sloping surface from the rear wall 34 of the base. There is preferably an angle iron plate 35 located in the inside front corner of the base to reinforce the front of the base at this point. A similar angled plate (not shown) reinforces the rear wall of the base. Additionally, there are front to rear extending braces located internally of the wedge-shaped base 11. The vertical side posts 12, 13 are welded or otherwise fixedly secured to the bottom rear section of the wedge-shaped base. Side plates 36 enclose the sides of the base 11.

With particular reference to FIG. 1 it will be seen that there is located atop the top surface 33 of the wedge-shaped base a shelf supporting frame 40. This frame functions to support parallel vertical rows and columns of shelves 70. All of the shelves have bottom walls 75 which slope downwardly and forwardly parallel to the top surface 33 of the base 11. Consequently, articles or products, such as packages of beverage cans 5 supported upon the shelves will slide forwardly over the shelves whenever the forwardmost package in a row of packages is removed from the shelf.

The shelf supporting frame 40 comprises side walls 45, as well as vertical divider walls 46, 47, extending parallel to the side walls 45. These walls 45, 46, 47 are all attached at the rear to the back panel 18 by conventional connectors (not shown). The side walls are formed by a plurality of spaced parallel right angle channels 48 tied together by front, middle and rear vertical rods 49, 50 and 51, respectively, and a pair of diagonal rods 52, 53. These rods are all welded to the channels 48 at the intersections of the rods and the channels. Each channel comprises a vertical leg 54 and an inwardly extending leg 55. The rods are welded to the vertical legs of the channels 48 such that the horizontal legs of the channels extend inwardly from the vertical legs of the channels to form shelf supports over which the shelves 70 are slidable.

In lieu of attaching the rear of the side walls 45 and divider walls 46, 47 to the back panel 18, the shelf supporting frame 40 may be made freestanding. In that event, rear wall 56 of the shelf supporting frame 40 would be formed by a plurality of rods or bars (not shown) welded or otherwise secured to the rearwardmost rods 51 of the side walls 45 and the rearwardmost rods of the dividers walls 46, 47.

The divider walls 46, 47 are substantially identical to the side walls 45, except that the divider walls have a pair of shelf supporting channels 60, 61 (FIGS. 1 and 5) welded or otherwise fixedly secured to the vertical rods 62 which tie together the vertically spaced parallel channels of the divider walls. Otherwise expressed, the divider walls 46, 47 are generally identical to the side walls 45, except that the dividers walls have a pair of channels 60, 61 welded to opposite sides of the rods at each vertically spaced location on the rods whereas the side walls 45 have only a single channel 48 welded to the rods at these sites.

As should now be readily apparent, the horizontal leg or flange of each channel 48, 60, 61 functions as a forwardly and downwardly sloping shelf support for one of the forwardly and downwardly sloping shelves 70 upon which the packages of beverage products 5 are supported.

Figure 3:
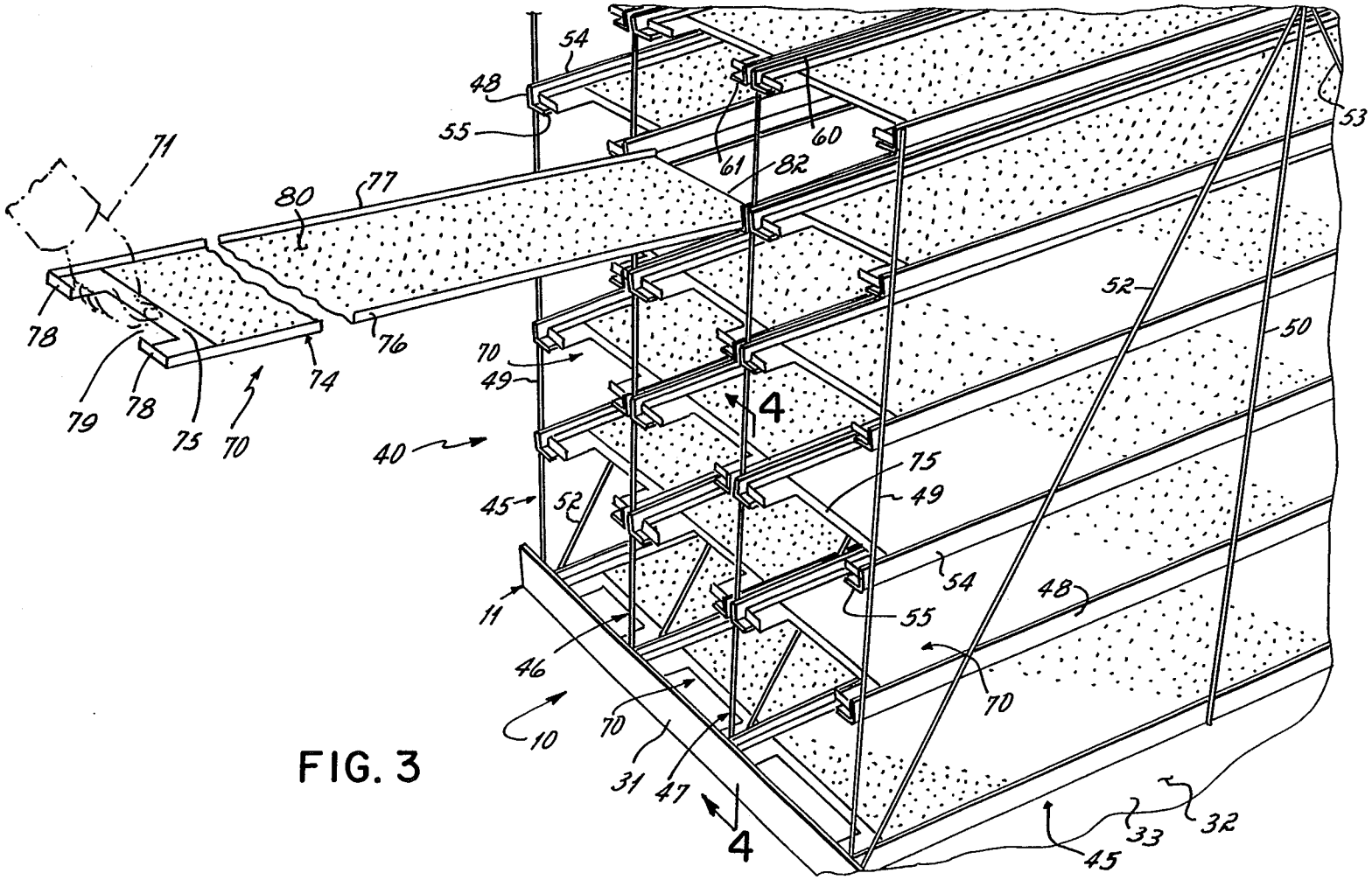
FIG. 3 is an enlarged perspective of a portion of the gondola display of FIG. 1, but with the displayed can products removed from the shelves and with one shelf pulled out for loading of product onto the shelf.

According to the practice of this invention, the shelves 70 which support the packages of beverage products 5 are slidable on the frame, rather than being fixed thereto. The slidability of these shelves enables the shelves 70 to be pulled forwardly from the frame so as to facilitate the loading of product onto the shelves. The manner in which the shelves may be pulled forwardly from the frame is illustrated in FIG. 3 wherein it is shown how a hand 71 may grasp the underside of the shelf, lift it upwardly and pull it forwardly until the rear of the shelf is supported solely by the frame 40 and the forward edge is supported by the hand of a person loading the shelf. Such a person would ordinarily hold the forward end of the shelf in one hand and load packages of product onto the shelf with the other hand. When the shelf was fully loaded, the person would push the loaded shelf rearwardly in the frame until downwardly extending tabs 72 on the underside of the shelf engage in holes 73 (FIG. 4) of the horizontal flanges 55 of the channels 48, 60 and 61 to lock the shelves against forward sliding movement in the frame.

Figure 5:
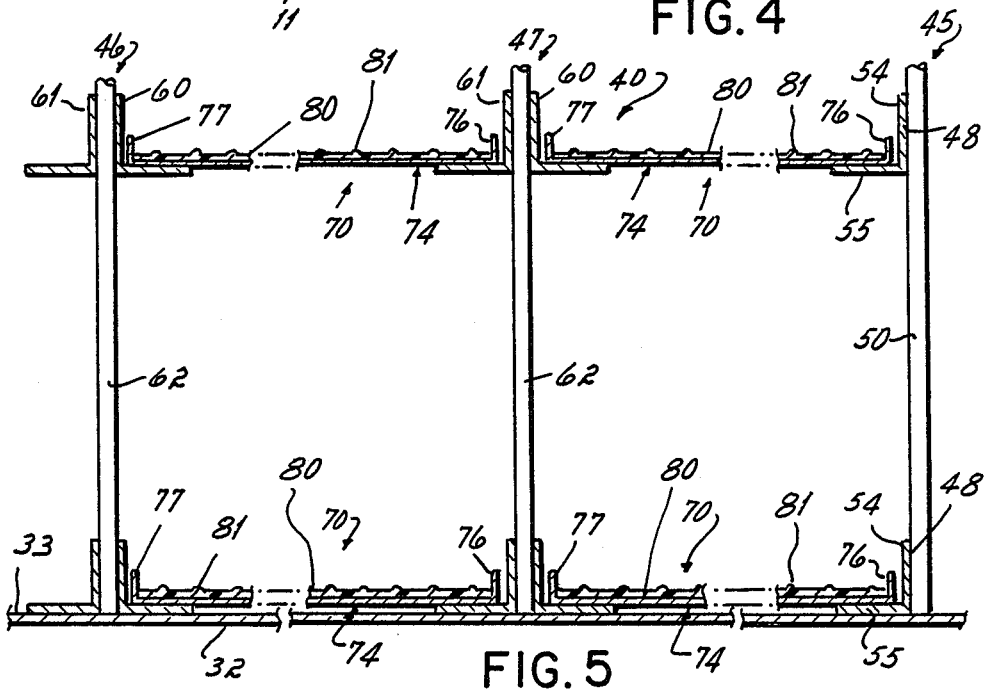
FIG. 5 is a cross-sectional view taken on line 5—5 of FIG. 4.

As may be seen most clearly in FIGS. 3, 4 and 5, each shelf 70 comprises a sheet metal pan 74 having a bottom wall 75, side walls 76, 77 extending upwardly from the bottom wall 75, and a front wall or lip 78 extending upwardly from the bottom wall. A recess 79 in the form of a rectangle is cut from the forward edge of the shelf so as to enable product supported upon the shelf to be engaged on the underside and lifted over the forward lip 78 of the shelf.

Rigidly mounted upon the top surface of the bottom wall 75 of each shelf 70 there is a slip surface element 80. In the preferred embodiment, this slip surface element comprises a section of extruded or cast plastic having silicone embedded therein so as to facilitate the sliding of product, such as a package of beverage cans 5, over the top surface of the slip surface element 80. In the preferred embodiment, this slip surface element has a plurality of ridges or ribs 81 (FIG. 5) formed on the top surface thereof so as to minimize the surface contact of the bottom of the cans or products supported upon the shelves with the supporting surface of the slip surface element 80. This slip surface element 80 is permanently adhered to the top surface of the bottom wall 75 of the shelf. It extends between the side walls 76, 77 of the shelf and from the rearward edge of the recess 79 back to the back edge 82 (FIG. 3) of the shelf.

The shelf supporting frame 40 is generally designed to handle only one size or height and width of product. The shelf supporting channels are vertically spaced apart approximately one inch more than the height of the product supported on the shelves. Except for the bottommost shelf, no greater spacing is required because the recesses 79 cut in the front of each shelf enable a person to reach the underside of the product, such as the package of beverage products 5, and lift that product upwardly over the lip 78 on the front of the shelf. That lip is usually approximately one-half inch in height. To remove product from the shelf 70, all that is required is to lift the forwardmost product supported on the shelf upwardly high enough for the bottom of the product to be located above the top surface of the lips 78 on the front of the shelves. When the product is lifted to that height, it may be pulled forwardly off of the front of the shelf. When the forwardmost package of products or the forwardmost product supported on a shelf is removed from the shelf, all of those products stored to the rear of the forwardmost product slide forwardly over the downwardly and forwardly sloping shelf until the next following product supported on the shelf engages the lip 78 on the forward end of the downwardly and forwardly sloping shelf.

The advantage of this construction of the shelf supportig frame and shelves supported thereby is that it enables a very large pack-out of product 5 to be supported upon the frame. Because the shelves are removable from the frame and may be pulled forwardly, as illustrated in FIG. 3, to load the shelves, the products 5 may be easily placed on the frame without the need to physically push all of the product on the shelf rearwardly in order to add additional products to the shelf. This would be the case if the shelves were fixedly secured to the frame. It also enables the frame to be placed against a rigid wall, such as the rear wall of the gondola, without any need to gain access through the rear wall in order to load product onto the shelves.

In FIG. 1, the shelf supporting frame has only been illustrated as extending over approximately one-half of the total surface area of the base 11. In accordance with the practice of this invention, and in order to facilitate the display of a greater variety of shapes and sizes of products, the remainder of the surface area of the base is utilized to support product 5*a* which is supported on the base 11 or on spring-up shelves 19 located above the base. These spring-up shelves 19 enable a greater variety of products and sizes of products to be supported upon the base than is possible with the shelf supporting frame 40 and shelves 70 supported thereon. It is within the scope of this invention, though, that the complete surface area of the base would be occupied by one or more shelf supporting frames 40. These frames might vary in spacing of the shelves thereon so as to enable differing sized and shaped products to be supported upon the same gondola display rack.

In FIG. 1, the section 85 of the display occupied by the spring-up shelves of the gondola has been demarked by phantom lines 86. This section 85 of the display is completely illustrated in FIG. 2. The spring-up shelf section of the gondola display rack 10 has been omitted from FIG. 1, except in diagrammatic fashion, in order to clarify the drawings, and particularly the portion of the drawings directed to the shelf supporting frame 40.

Figure 7:
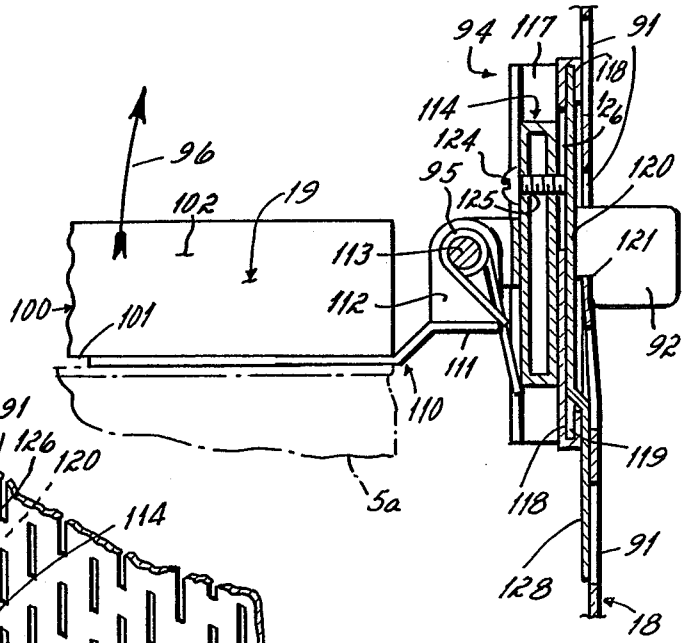
FIG. 7 is a cross-sectional view taken on line 7—7 of FIG. 6.
Figure 6:
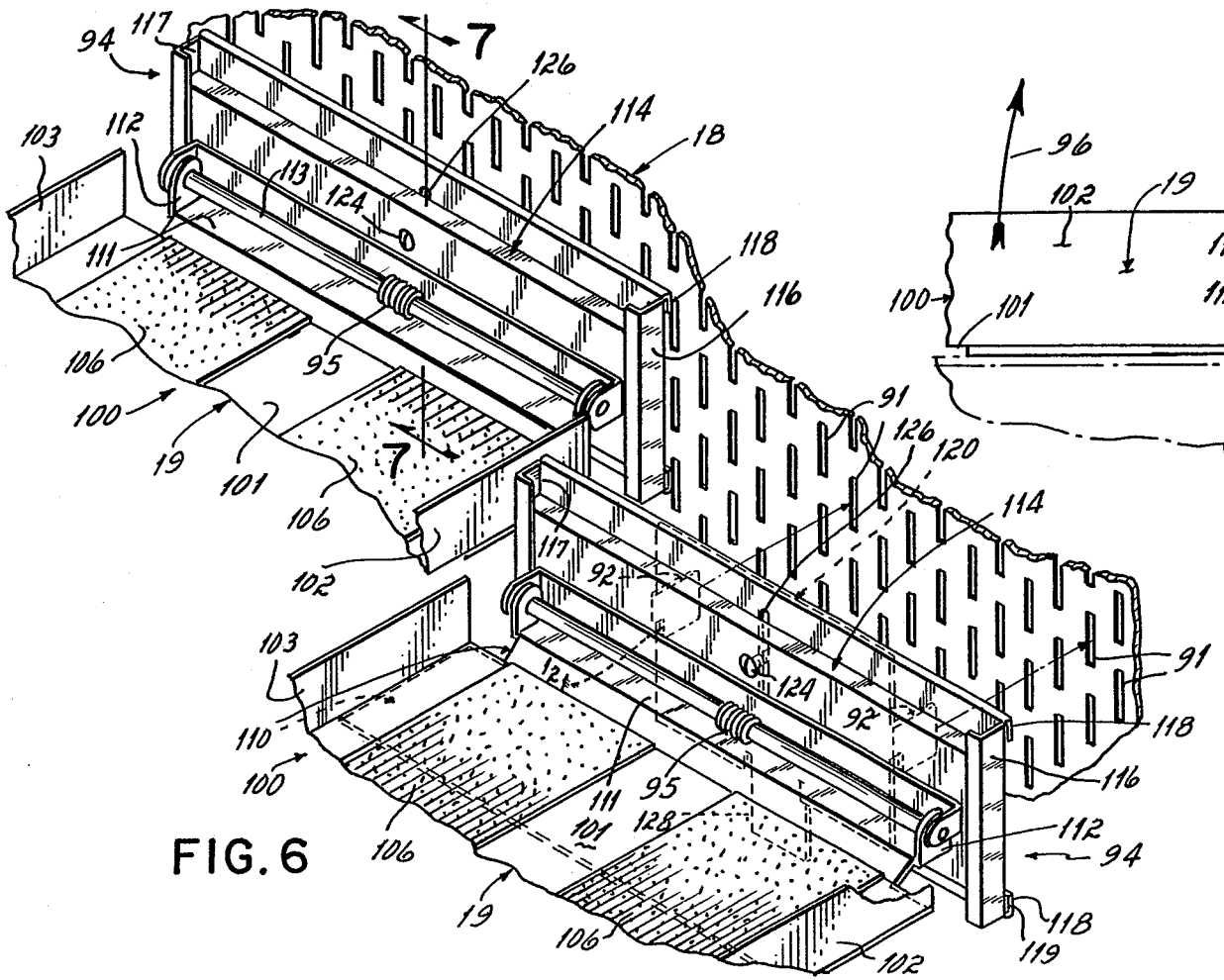
FIG. 6 is an enlarged perspective view of a portion of two adjacent spring-up shelves, one shelf being disassembled from the gondola.

Referring now to FIGS. 2, 6 and 7, it will be seen that the section 85 of the gondola display rack 10 comprises a plurality of spring-up shelves 19 supported from the back panel 18 of the rack 10. This back panel 18 extends between the side posts 12 and 13 and is fixedly attached thereto.

The back panel 18 has a plurality of spaced slots formed in the panel. These slots 91 are arranged in vertical columns and horizontal rows. With reference particularly to FIG. 2, it will be seen that the slots 91 of each horizontal row are spaced apart the same distance as the slots of the adjacent row. The slots of adjacent rows, though, are laterally offset so that the slots of one row partially overlap in the vertical direction the slots of an adjacent row. As explained more fully hereinafter, this spacing of the slots enables the shelves to be more closely spaced than would be the case if the slots did not vertically overlap the slots of an adjacent row.

The slots 91 are adapted to receive ears or tabs 92 of a spring-up shelf supporting bracket assembly 94. Extending forwardly from each of these shelf supporting bracket assemblies 94 is a spring-up shelf 19. Springs 95 of the bracket assemblies 94 bias these shelves upwardly, as indicated by the arrow 96 of FIG. 7, to a position in which the shelves are disengaged from products or cans mounted beneath the shelf such that the exposed products are accessible for removal of the cans or products. The position of the shelves 19 when product has been removed therefrom is best illustrated in FIG. 2 wherein there are two shelves 19*a* and 19*b* which have been moved upwardly to their uppermost position in which the products supported on the next adjacent lower shelf is exposed and accessible.

The purpose of spring-up shelves is to enable products to be stacked in columns supported upon the spring-up shelves and, when the product is removed from the topmost shelf, to have the front end of that shelf spring up about a rearward pivot so that the shelf no longer interferes with the removal of product on the next lower shelf. The shelves 19 function in this way to enable product to be stacked upon a plurality of shelves without any spacing between the top of the row of products 5*a* and the bottom of the shelves 19 above the row. Because the shelves do not carry or support the weight of the product, they may be made relatively light and may be cantilevered from the back panel 18 of the display.

As is best illustrated in FIGS. 1 and 2, the lowermost rows of product supported in the section 85 of the gondola rack 10 are supported upon the top surface 33 of the base. This section is divided into columns by dividers 22 identical to the dividers which divide the space on the shelves 17 into columns. Slip surface elements 24*a* similar to the slip surface elements 24 on the shelves 17 are located between the dividers 22 on the top surface 33 of the base. These slip surface elements 24*a* facilitate sliding of product stored on the base to the forward edge of the base upon removal of the forwardmost product in a column. The spacing between the dividers 22 on the base 11 is the same as the width of the spring-up shelves 19 located above the column formed by the dividers 22.

There are advantages to the use of spring-up shelves, such as are employed in the section 85 of the gondola display rack 10, over the fixed shelf supporting frame 40, and there are advantages to the fixed supporting frame section of the display rack over the spring-up shelves. Specifically, the fixed shelf supporting frame 40 has the advantage that differing products may be stacked one atop the other within the shelf supporting frame section of the rack, and still, each different product will be accessible even though there are differing products mounted atop it. The fixed shelf supporting frame section of the rack, though, has the disadvantage that it requires an inch or so of vertical clearance or spacing between adjacent rows of product in order to enable the products to be removed. It is also more difficult to load than the spring-up shelf section. The spring-up section, though, is capable of greater density or pack-out than the fixed shelf supporting frame 40, but it requires that all product in a vertical column of product be the same because the lowermost product is not accessible until the product above it has been removed.

With reference to FIGS. 2 and 6, it will be seen that each spring-up shelf 19 comprises a shelf pan 100, preferably made of lightweight plastic, having a bottom section 101 and a pair of upwardly turned side walls 102, 103. A front wall 105 in the form of a section of extruded plastic channel is preferably secured to the bottom 101 of the shelf pan 100. This section of plastic channel 105 is intended to receive pricing or other information on tabs which may be mounted within a channel formed in the section 105.

Supported upon the top surface of the bottom wall 101 of the pan 100, there is preferably a plastic slip surface element 106. In the preferred embodiment, two parallel strips of slip surface element are adhesively secured to the top surface of the bottom wall of the shelf pan 100 so as to facilitate sliding of product over the top surface of the shelf 19. This slip surface element 106 in the preferred embodiment is substantially identical to the slip surface element 80 described hereinabove as being mounted upon the shelves 70, except that the two slip surface strips are narrower than the slip surface element 80 of the slide-out shelves 70. Specifically, it comprises a plastic material having silicone impregnated therein so as to facilitate sliding of packages or bottles over the surface of the material.

The shelf supporting bracket assembly 94 upon which the spring-up shelves 19 are mounted comprises a shelf supporting bracket 110 adhered or otherwise fixedly secured to the rear of the shelf 19. This bracket has a rearward extension 111 from which a pair of ears 112 extend upwardly. These ears 112 have holes formed therein, which holes are received over a shaft 113 such that the bracket and attached shelf 19 may pivot about the shaft, thereby enabling the shelf to be movable between its downwardly and forwardly sloping loaded position, and its upwardly and forwardly sloping unloaded position. The shaft 113 supports the torsion spring 95 which biases the shelf to its upwardly sloping position. The shelves **19*a* and 19*b* are illustrated in FIG. 2 in the upwardly and forwardly sloping position, while the other shelves 19 are illustrated in this Figure in their downwardly and forwardly sloping loaded position wherein the shelves extend parallel to the downwardly sloping top surface 33 of the base 11**.

The shaft 113 is supported from a vertically movable saddle 114, which saddle is mounted within a vertical channel 117 of a slide 116. The slide 116 has channel defining flanges extending from opposite forward sides of the slide. On its rear side, the slide also has a horizontal slideway 119 defined by top and bottom flanges 118. This horizontal slideway 119 supports a mounting plate or mounting bracket 120 from which the ears 92 extend rearwardly. There are two such ears 92 spaced apart a multiple of the distance between adjacent slots 91 in the rows of slots formed in the back panel 18. In the illustrated embodiment, the ears 92 are spaced apart four times the distance between adjacent slots in a horizontal row of slots in the back panel.

The ears or tabs 92 are generally hook shaped and extend rearwardly at 90° to the vertical plane of the mounting plate 120. These hook-shaped ears 92 provide a slot 121 in the ear such that the ears may be inserted into a slot 91 of the back panel 18 and then moved vertically downwardly so as to lock the mounting plate to the back panel 18.

As should now be appreciated, the spring-up shelves 19 are infinitely adjustable both horizontally and vertically on the back panel 18. In order to mount the spring-up shelves on the back panel 18, a column of product is first loaded onto the top surface of the wedge-shaped base 11. With that column in place, a first spring-up shelf **19*c* is placed atop that product column and the shelf supporting bracket assembly of that shelf attached to the back panel 18. This is accomplished by centering the mounting plate 120 relative to the horizontal slideway 119 in the slideway bracket 116 and centering the vertical slide 114 in the vertical slideway 117 on the front side of this same slideway bracket. The tabs 92 of the mounting plate 120 are then positioned in the closest pair of mounting slots of the back panel 18. The rear of the spring-up shelf 19 is then pushed downwardly against the top surface of the row of products supported upon the top surface 33 of the base. While the rear of the shelf is held against the top surface of the base, the shelf is moved laterally to the particular desired position in which the side walls 102, 103 of the shelf align with the dividers 22 of a channel on the top surface 33 of the base 11. When the shelf has thus been horizontally and vertically positioned, the shelf support bracket assembly 94 is locked in the newly adjusted position by a screw 124 which extends through a threaded bore 125 in the slide 114 and through a slot 126 in the slideway bracket 116 into engagement with the mounting plate 120. This screw then locks the shelf supporting bracket assembly 94 in a position of horizontal and vertical adjustment relative to the mounting plate 120**.

After one spring-up shelf **19*c* has been mounted upon the back panel 18, then that shelf is loaded with product 5*a*, and the next spring-up shelf 19*d* is positioned atop that row of product. That next shelf 19*d* is then mounted in the same manner that the shelf 19*c* was mounted and adjustably positioned on the back panel 18**. This process is repeated until all of the spring-up shelves are properly positioned and fixedly secured to the back panel with product contained on each shelf.

In the preferred embodiment of the invention, the mounting plate 120 of each shelf support bracket assembly 94 has a downwardly extending tab or ear 128 which bears against the front surface of the back panel 18. This tab prevents the mounting plate 120 from lifting upwardly and possibly having the ears 92 disengage from the slots 91 when the shelf snaps upwardly after the last item of product **5*a*** on a shelf is removed therefrom.

In use, product is removed from the topmost one of the product supporting shelves 19 until all of the product is removed therefrom. After each item of product is removed from the front of the shelf, all of the products then remaining on the shelf slide forwardly until the then forwardmost item of product on the shelf engages the front wall 105 of the shelf. When all of the product has been removed from a particular shelf, the front of the shelf springs upwardly as the shelf pivots about the pivot shaft 113 so as to expose products stored on the next lowermost shelf. This process is repeated until all of the shelves have sprung out of the way and the products supported upon the top surface 33 of the wedge-shaped base are exposed for removal.

Figure 8:
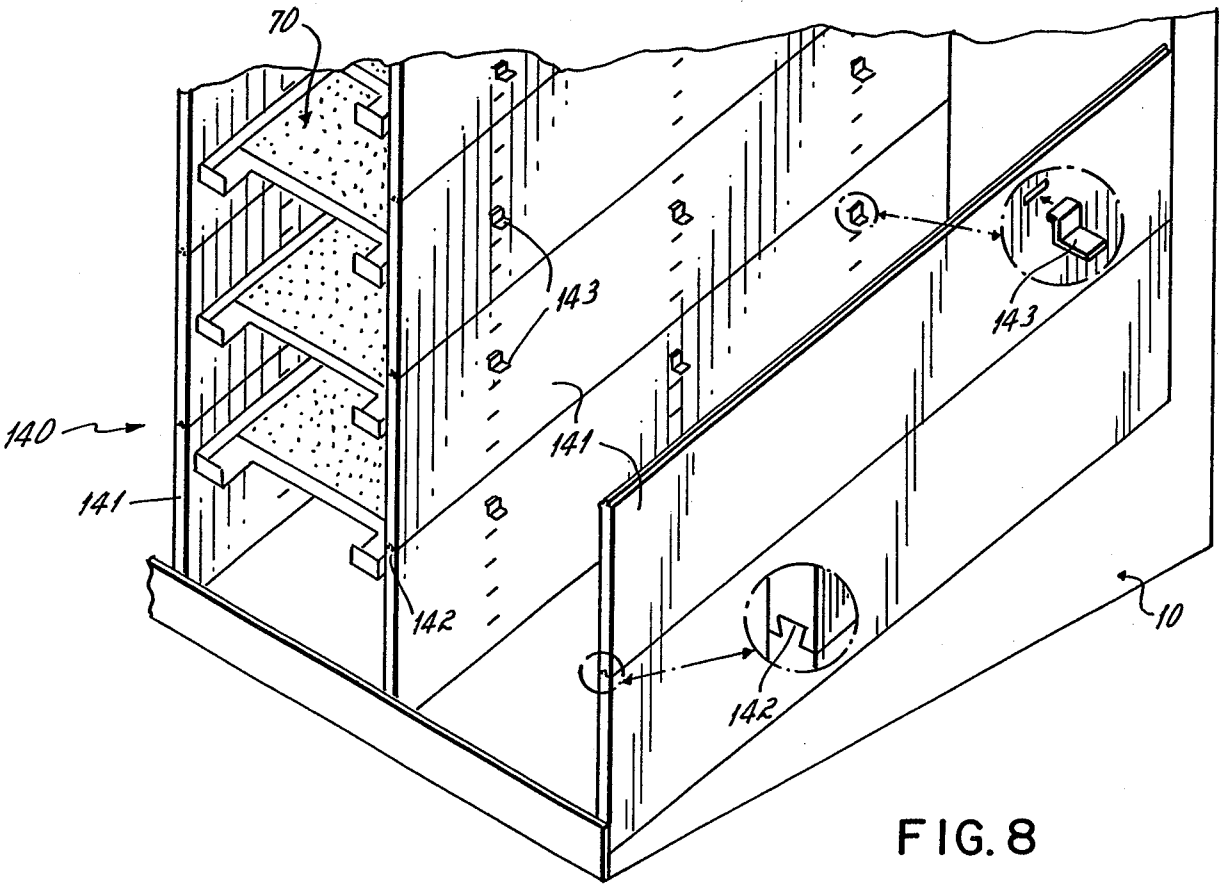
FIG. 8 is a perspective view of a second modification of a portion of the gondola display of FIG. 1.

With reference to FIG. 8, there is illustrated another embodiment of the fixed shelf supporting frame 40 illustrated in FIGS. 1 and 3–5. In this embodiment, the frame 140 is manufactured from a plurality of identical panels 141, which panels have a dovetail-shaped bead or groove 142 formed along the top edge thereof and a mating dovetail-shaped channel formed in the bottom edge thereof. The side walls and divider walls of the frame are assembled by simply longitudinally sliding the dovetail-shaped bead 142 of one panel into the dovetail-shaped channel of the adjacent panel to build up a side wall or a vertical divider wall to the desired height. The side walls, rather than having the shelf supporting channels fixedly secured thereto, utilize conventional snap-in shelf supporting brackets 143 mountable in vertically spaced slots preformed in the panels to support the shelves 70. The shelves 70 of this embodiment are identical to the shelves of the embodiment of FIGS. 1–5.

The advantage of this second embodiment of fixed shelf supporting frame 140 over the frame 40 is that it provides greater flexibility in the spacing between shelves. It also has the advantage of utilizing identical modules or panels 141 to form differing height and width display racks with consequent cost savings.

While I have described only two embodiments of my invention, persons skilled in this art will appreciate changes and modifications which may be made without departing from the spirit of my invention. Therefore, I do not intend to be limited except by the scope of the following claims.

I claim:

1. A gondola display rack for merchandising products supported upon said rack, said rack comprising a fixed base, at least one upright extending vertically from the rear of said fixed base, said upright having at least two parallel columns of vertically spaced slots therein, at least one shelf, shelf supporting bracket means engageable with said slots of said upright to support said shelf from said upright in a position cantilevered over said fixed base, both said fixed base and said shelf having a product supporting top surface, stop means at the front edge of said top surface of said base and said shelf, both said shelf and said base having a top surface angled downwardly and forwardly at a sufficient slope as to enable products supported upon said top surface to slide by gravity of their own weight forwardly and downwardly over said top surface into engagement with said stop means on the front edges of said base and shelf, and additional spring-up shelf means attached to said upright and extending forwardly from said upright over said base, said additional spring-up shelf means sloping downwardly and forwardly from said upright when loaded with products atop said spring-up shelf means, and said spring-up shelf means sloping forwardly and upwardly to expose products mounted beneath said spring-up shelf means when all products are removed from atop said spring-up shelf means.

2. The gondola display rack of claim 1 which further includes slip surface means mounted on said top surface of at least one of said shelf and said base, said slip surface means comprising strips of silicone impregnated plastic.

3. The gondola display rack of claim 1 wherein row dividers are attached to one of the shelf and base so as to divide at least one of said top surfaces into multiple rows extending from front to back of said one top surface.

4. The gondola display rack of claim 3 which further includes strips of silicone impregnated plastic located between said row dividers.

5. A gondola display rack for merchandising products supported upon said rack, said rack comprising a fixed base, at least one upright extending vertically from the rear of said fixed base, said upright having at least two parallel columns of vertically spaced slots therein, at least one shelf, shelf supporting bracket means engageable with said slots of said upright to support said shelf from said upright in a position cantilevered over said fixed base, both said fixed base and said shelf having a product supporting top surface, stop means at the front edge of said top surface of said base and said shelf, both said shelf and said base having a top surface angled downwardly and forwardly at a sufficient slope so as to enable products supported upon said top surface to slide by gravity of their own weight forwardly and downwardly over said top surface into engagement with said stop means on the front edges of said base and shelf, and additional spring-up shelf means attached to said upright and extending forwardly from said upright over said base, said spring-up shelf means extending downwardly and forwardly from said upright parallel to said top surface of said base when loaded with products atop said spring-up shelf means, and said spring-up shelf means being automatically movable away from products supported beneath said spring-up shelf means when all products are removed from atop said spring-up shelf means.

6. A gondola display rack for merchandising products supported upon said rack, said rack comprising a fixed base, at least one upright extending vertically from the rear of said fixed base, said upright having at least two parallel columns of vertically spaced slots therein, at least one shelf, shelf supporting bracket means engageable with said slots of said upright to support said shelf from said upright in a position cantilevered over said fixed base, both said fixed base and said shelf having a product supporting top surface, stop means at the front edge of said top surface of said base and said shelf, both said shelf and said base having a top surface angled downwardly and forwardly at a sufficient slope so as to enable products supported upon said top surface to slide by gravity of their own weight forwardly and downwardly over said top surface into engagement with said stop means on the front edges of said base and shelf, a frame mounted upon said fixed base, and a plurality of additional shelves mounted upon said frame, said additional shelves being arranged in side-by-side rows and in spaced vertical columns, each of said additional shelves having stop means on the forward edge thereof, and each of said additional shelves sloping downwardly and forwardly parallel to said downwardly and forwardly sloping top surface of said fixed base.

7. The gondola display rack of claims 1 or 5 in which said spring-up shelf means includes stop means at the front edge of said spring-up shelf means and a top slip surface, said top slip surface having a sufficiently low coefficient of friction with products supported upon said top slip surface that products supported upon said top slip surface slide by gravity of their own weight forwardly and downwardly toward said stop means at the front of said spring-up shelf means.

8. The gondola display rack of claim 6 wherein each of said additional shelves is movably mounted upon said frame such that said additional shelves may be individually pulled forwardly on said frame for loading of product onto said shelves.

9. The gondola display rack of claim 6 wherein each of said additional shelves is movably mounted upon said frame such that said additional shelves may be individually pulled forwardly on said frame until only the rear end of said forwardly pulled shelf is supported by said frame for loading of product onto said forwardly pulled shelf.

10. The gondola display rack of claim 6 wherein each of said additional shelves has slip surface means on the top surface thereof, said slip surface means on said additional shelves being of sufficiently low coefficient of friction that products supported upon said slip surface means slide by gravity of their own weight forwardly and downwardly toward said stop means at the front of said additional shelves.

11. An adjustable shelf assembly for use on a display rack, said assembly comprising a shelf supporting bracket, said bracket having means thereon for securing said bracket to a display rack, a slide mounted upon said bracket, said slide being mounted for transverse adjustment on said bracket, a saddle mounted upon said slide, said saddle being mounted for vertical adjustment on said slide, locking means for securing said saddle and slide in positions of adjustment on said shelf supporting bracket, and a product supporting shelf mounted upon said saddle.

12. The adjustable shelf assembly of claim 11 wherein said product supporting shelf is pivotally supported upon said saddle.

13. The adjustable shelf assembly of claim 12 which further includes torsion spring means operable between said product supporting shelf and said saddle for biasing said product supporting shelf toward a vertical orientation.

14. The adjustable shelf assembly of claim 11 which further includes a pivot pin mounted upon said saddle, said product supporting shelf being pivotally supported from said pivot pin.

15. The adjustable shelf assembly of claim 14 which further includes a torsion spring mounted upon said pivot pin, said torsion spring being operable to bias said shelf toward a vertical orientation.

16. The adjustable shelf assembly of claim 15 wherein said torsion spring is operable to raise said shelf away from product located beneath said shelf when all product has been removed from atop said shelf.

17. A display rack for merchandising products supported upon said rack, said rack comprising a fixed base, at least one upright extending vertically from the rear of said fixed base, said fixed base having a product supporting top surface, stop means at the front edge of said top surface of said base, said top surface of said base being angled downwardly and forwardly at a sufficient slope so as to enable products supported upon said top surface to slide by gravity of their own weight forwardly and downwardly over said top surface into engagement with said stop means on the front edge of said base, and spring-up shelf means attached to said upright and extending forwardly from said upright over said base, said spring-up shelf means sloping downwardly and forwardly parallel to said top surface of said base when loaded with products atop said spring-up shelf means, and said spring-up shelf means pivoting to a forwardly and upwardly sloping position to expose products mounted beneath said spring-up shelf means when all products are removed from atop said spring-up shelf means.

18. A display rack for merchandising products supported upon said rack, said rack comprising a fixed base, at least one upright extending vertically from the rear of said fixed base, said fixed base having a product supporting top surface, stop means at the front edge of said top surface of said base, said top surface of said base being angled downwardly and forwardly at a sufficient slope so as to enable products supported upon said top surface to slide by gravity of their own weight forwardly and downwardly over said top surface into engagement with said stop means on the front edge of said base, and spring-up shelf means attached to said upright and extending forwardly from said upright over said base, said spring-up shelf means extending downwardly and forwardly from said upright parallel to said top surface of said base when loaded with products atop said spring-up shelf means, and said spring-up shelf means being automatically movable away from products supported beneath said spring-up shelf means when all products are removed from atop said spring-up shelf means.

19. The display rack of claims 17 or 18 in which said spring-up shelf means includes stop means at the front edge of said spring-up shelf means and a top slip surface, said top slip surface having a sufficiently low coefficient of friction with products supported upon said top slip surface to enable said products to slide by gravity of their own weight forwardly and downwardly toward said stop means at the front of said spring-up shelf means.

20. The display rack of claim 18 wherein said spring-up shelf means comprises a shelf supporting bracket, said bracket having means thereon for securing said bracket to said upright, a slide mounted upon said bracket, said slide being mounted for transverse adjustment on said bracket, a saddle mounted upon said slide, said saddle being mounted for vertical adjustment on said slide, locking means for securing said saddle and slide in positions of adjustment on said shelf supporting bracket, and a product supporting shelf mounted upon said saddle.

21. The display rack of claim 20 wherein said product supporting shelf is pivotally supported upon said saddle.

22. The display rack of claim 21 which further includes torsion spring means operable between said product supporting shelf and said saddle for biasing said product supporting shelf toward a vertical orientation.

23. The display rack of claim 20 which further includes a pivot pin mounted upon said saddle, said product supporting shelf being pivotally supported from said pivot pin.

24. The display rack of claim 23 which further includes a torsion spring mounted upon said pivot pin, said torsion spring being operable to bias said shelf toward a vertical orientation.

25. The display rack of claim 24 wherein said torsion spring is operable to raise said shelf away from products located beneath said shelf when all products have been removed from atop said shelf.

26. A merchandising display comprising a vertical upright, said upright having a plurality of rows of vertically spaced slots, said slots being equidistantly spaced within the vertical rows, and the slots of each vertical row being vertically offset from the slots of the adjacent vertical rows, a shelf supporting bracket, said bracket having hook means extending rearwardly therefrom and receivable within said slots of said upright for securing said bracket to the upright of said display, a slide mounted upon said bracket, said slide being mounted for transverse adjustment on said bracket, a saddle mounted upon said slide, said saddle being mounted for vertical adjustment on said slide, locking means for securing said saddle and slide in positions of adjustment on said shelf supporting bracket, and a product supporting shelf mounted upon said saddle.

27. The display of claim 26 wherein said bracket has at least two horizontally spaced hook means extending rearwardly therefrom, said two hook means being receivable within a pair of slots of said upright, which pair of slots are located in the same horizontal plane.

28. The display of claim 26 wherein said product supporting shelf is pivotally supported upon said saddle.

29. The display of claim 28 which further includes torsion spring means operable between said product supporting shelf and said saddle for biasing said product supporting shelf toward a vertical orientation.

30. The display of claim 26 which further includes a pivot pin mounted upon said saddle, said product supporting shelf being pivotally supported from said pivot pin.

31. The display of claim 30 which further includes a torsion spring mounted upon said pivot pin, said torsion spring being operable to bias said shelf toward a vertical orientation.

32. The display of claim 31 wherein said torsion spring is operable to raise said shelf away from product located beneath said shelf when all product has been removed from atop said shelf.

33. A merchandising display comprising a vertical upright, said upright having a plurality of parallel rows of vertically spaced slots, said slots being equidistantly spaced within the vertical rows, a plurality of shelf supporting brackets, each of said brackets having hook means extending rearwardly therefrom and receivable within said slots of said upright for securing said bracket to the upright of said display, a slide mounted upon each of said brackets, said slides being mounted for transverse adjustment on said brackets, a saddle mounted upon each of said slides, said saddles being mounted for vertical adjustment on said slides, locking means for securing said saddles and slides in positions of adjustment on said shelf supporting brackets, and a product supporting shelf mounted upon each of said saddles, said product supporting shelves being adapted to be placed in side-by-side abutting relationship as a consequence of the adjustability of said saddles and slides on said brackets.

34. The display of claim 33 wherein each of said brackets has at least two horizontally spaced hook means extending rearwardly therefrom, said two hook means of each bracket being receivable within a pair of slots of said upright, which pair of slots are located in the same horizontal plane.

35. The display of claim 33 wherein each of said product supporting shelves is pivotally supported upon said saddles.

36. The display of claim 35 which further includes torsion spring means operable between said product supporting shelves and said saddle for biasing said product supporting shelves toward a vertical orientation.

37. The display of claim 33 which further includes a pivot pin mounted upon each of said saddles, said product supporting shelves being pivotally supported from said pivot pins.

38. The display of claim 37 which further includes a torsion spring mounted upon each of said pivot pins, said torsion springs being operable to bias said shelves toward a vertical orientation.

39. The display of claim 38 wherein each of said torsion springs is operable to raise one of said shelves away from product located beneath said one of said shelves when all product has been removed from atop said one of said shelves.

* * * * *

UNITED STATES PATENT AND TRADEMARK OFFICE

CERTIFICATE OF CORRECTION

PATENT NO. : 4,809,855

DATED : 3/7/89

INVENTOR(S) : Rafael T. Bustos

It is certified that error appears in the above-identified patent and that said Letters Patent is hereby corrected as shown below:

Col. 11, line 25, "as to" should read --so as to--.

Signed and Sealed this

Twenty-second Day of September, 1992

*Attest:*

DOUGLAS B. COMER

*Attesting Officer*

*Acting Commissioner of Patents and Trademarks*